US005366008A

United States Patent [19]

Kadle et al.

[11] Patent Number: 5,366,008

[45] Date of Patent: Nov. 22, 1994

[54] METHOD OF MANUFACTURING HEADERED CONDENSERS

[75] Inventors: Prasad S. Kadle, Getzville; Larry A. O'Keefe, Newfane, both of N.Y.

[73] Assignee: General Motors Corporation, Detroit, Mich.

[21] Appl. No.: 106,663

[22] Filed: Aug. 16, 1993

[51] Int. Cl.[5] ..... F28F 9/02

[52] U.S. Cl. ..... 165/173; 165/175

[58] Field of Search ..... 165/153, 173, 175; 29/890.039, 890.04

[56] References Cited

U.S. PATENT DOCUMENTS

| | | | |
|---|---|---|---|
| 2,164,628 | 7/1939 | Sibley | 165/173 |
| 2,580,715 | 1/1952 | Baber | 165/175 |
| 3,581,814 | 6/1971 | Jackson | 165/175 X |
| 4,799,306 | 1/1989 | Collins et al. | 29/453 |
| 5,051,020 | 9/1991 | Schleicher | 403/282 |
| 5,195,579 | 3/1993 | Buchanan | 165/173 X |
| 5,195,581 | 3/1993 | Puntambekar et al. | 165/173 |

FOREIGN PATENT DOCUMENTS

| | | | |
|---|---|---|---|
| 17410 | 10/1980 | European Pat. Off. | 165/173 |
| 169498 | 7/1988 | Japan | 165/173 |

*Primary Examiner*—John Rivell
*Assistant Examiner*—L. R. Leo
*Attorney, Agent, or Firm*—Patrick M. Griffin

[57] ABSTRACT

A heat exchanger is formed by a pair of tank units with a core therebetween. The core comprises a plurality of tube passes extending between and in fluid communication with the tank units, and air centers connected between the tube passes in conductive heat transfer with air and the flow passes. The tank units are formed by separate tanks and headers. The tanks and headers include a flat, coplanar perimeter flange extending thereabout. The flanges include locking members therethrough to secure the header to the tank. The locking members may comprise longitudinal projections formed through the tank flange projecting through the header flanges, or alternatively aligned apertures in the flanges with plug inserted therethrough.

1 Claim, 4 Drawing Sheets

METHOD OF MANUFACTURING HEADERED CONDENSERS

TECHNICAL FIELD

The invention relates to heat exchangers of the type having a pair of tank units comprising separate headers and tanks with parallel flow passes and air centers extending between tank units, and more particularly to the locking of the headers to the tanks for brazing thereof.

BACKGROUND OF THE INVENTION

Heat exchangers used in motor vehicle air conditioning systems, namely condensers, commonly have a plurality of parallel flat sided extruded tubes connected at opposite ends to a pair of headered tanks, and air centers connected between the tubes to facilitate efficient heat transfer to the surrounding area. The tanks generally comprise separate headers with slots therethrough for receiving the ends of the extruded tubes, and a tank member secured to the header to supply refrigerant and receive same from the tubes. The air centers are brazed to the sides of adjacent tubes, and the tubes are brazed or otherwise bonded to the header along with the tanks to assure leakfree joints.

During assembly, the header and tanks must be secured to one another so that brazing can seal the joints therebetween. It has been known to align and fasten the tank to the header by use of self-contained preformed tabs at spaced intervals about the periphery of the header or tank as disclosed in U.S. Pat. No. 4,971,145, issued Nov. 20, 1990 in the name of Lyon and assigned to the assignee of the subject invention. The preformed tabs are clinched about and over the adjoining header or tank to provide proper alignment between the mating tank and header, and also provide appropriate contact pressure to facilitate the joining or brazing process.

Unrelated to the application of exchangers or condensers, various types of snaps or interlocking members have been known to attach two members to one another. U.S. Pat. No. 5,051,020, issued Sep. 24, 1991 in the name of Schleicher discloses a leak proof joint wherein the joint retains overlapping sheets of a deformable material. The joint is comprised of nested cup shaped cavities formed out of the plane of the sheets having a central spot and a continuous wall region extending from the spot to the cavity periphery. The region of the sheets adjacent the cavity periphery is pinched together causing the cavity walls to inwardly radially deform, securely interlocking the sheets firmly together.

U.S. Pat. No. 4,799,306, issued Jan. 24, 1989 in the name of Collins et al discloses a method of securing handles to plastic containers which includes inserting a snap into an aperture.

SUMMARY OF THE INVENTION

The invention relates to a heat exchanger apparatus of the type including a pair of longitudinal tank units supporting a core therebetween. The core has a plurality of parallel flow tube passes extending between the tank unit and air centers connected therebetween for directing air flow therethrough in conductive heat transfer with the tube passes. The apparatus comprises a pair of tank units providing fluid spaces therein in fluid communication with the tube passes. Each of the tank units comprises a separate tank and header each having coplanar flanges extending the periphery of the header and tank for providing parallel flat abutting surfaces therealong to seal the tank unit during brazing thereof. The flat abutting surfaces of the flanges of the header are parallel to those of the tank for providing uniform contact. The flanges include locking means extending through and within each flange for locking the tank to the header for brazing thereof between the surfaces thereof.

A further object of the invention is to extrude the separate tank and header with aluminum material and provide cladding on one of the parts of the aluminum tank units to allow brazed sealed joints to be formed between the parallel abutting surfaces.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
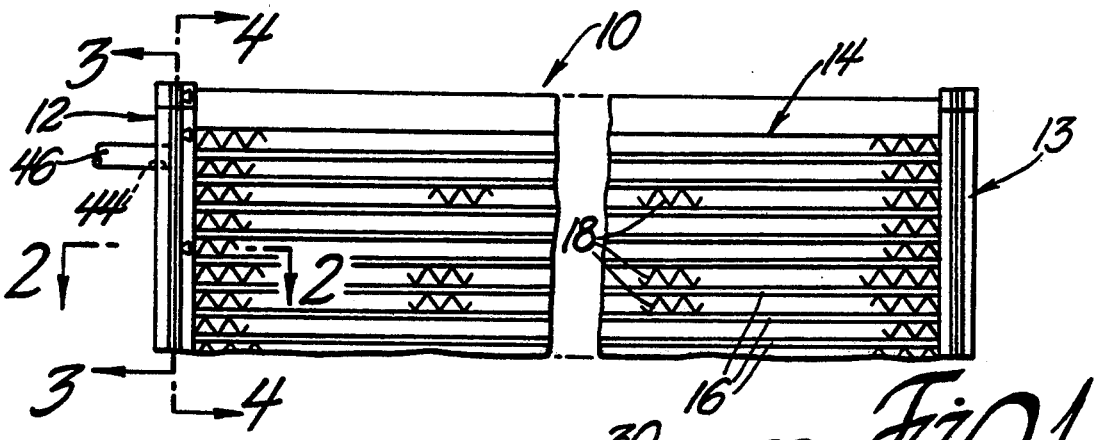
FIG. 1 is a front elevational view of the heat exchanger of the subject invention.

A heat exchanger apparatus is generally shown at 10 in FIG. 1. In the preferred embodiment, the heat exchanger 10 is generally a condenser of the type utilized in motor vehicle air conditioning systems. While the ensuing description is directed toward a condenser for motor vehicle air conditioning systems, the invention clearly applies to other heat exchangers and applications as well.

The heat exchanger 10 comprises a pair of tank units 12, 13. The tank units 12, 13 support a core 14 therebetween. The core 14 comprises a plurality of flat sided extruded tubes 16 arranged in parallel relationship for providing parallel flow tube passes. Air centers 18 of sinusoidal configuration are arranged between the extruded tubes 16 for thermal coupling of the tubes with ambient air. The ends of the extruded tubes 16 are connected to the tank units 12, 13 to provide fluid communication across the condenser. The extruded tubes 16 are in fluid communication with fluid chambers 20 formed within the tank units 12, 13. The chambers 20 contains the refrigerant used in the condensers 10.

The following description relates to the tank unit 12, however, it is to be understood that the tank unit 13 is similar in construction. The tank unit 12 is formed by a separate header 22 and tank 24. The header 22 includes a plurality of tube slots 26 therethrough for receiving the ends of the extruded tubes 16.

Figure 2:
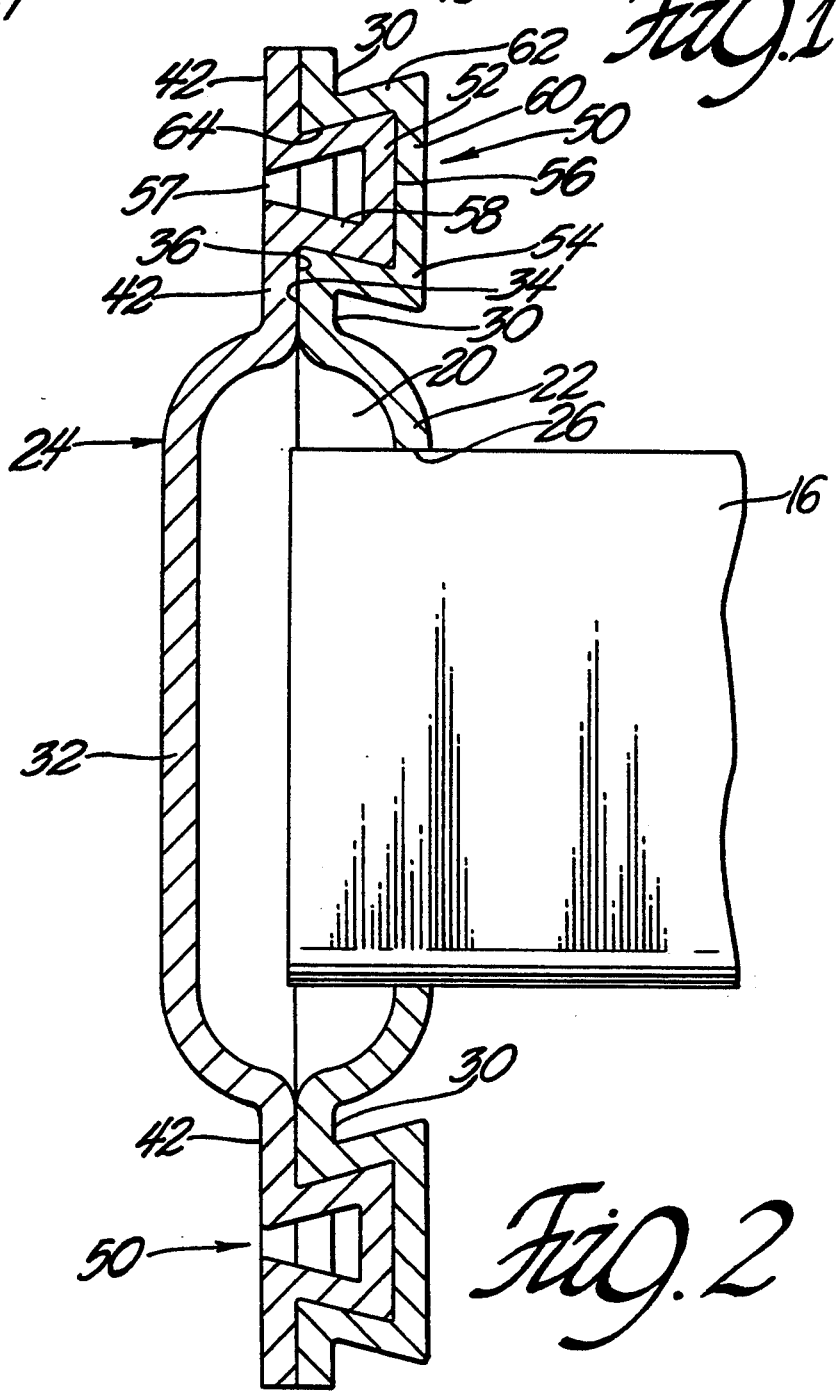
FIG. 2 is an enlarged cross sectional view taken along lines 2—2 of FIG. 1 showing a first embodiment of the locking means.
Figure 4:
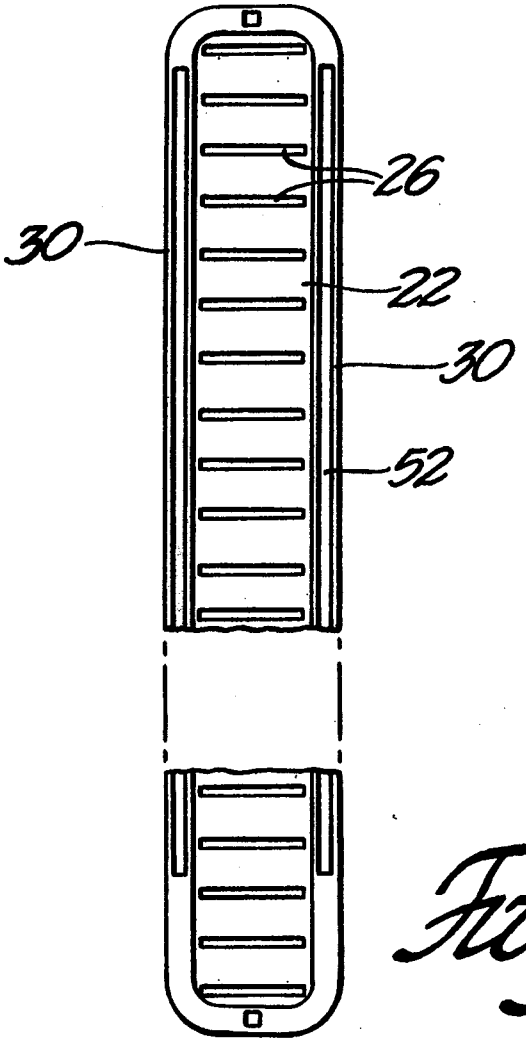
FIG. 4 is an enlarged front elevational view of the header of the subject invention taken along lines 4—4 of FIG. 1.

The header 22 is best shown in FIGS. 2 and 4. The perimeter or periphery of the header 22 is formed by a continuous flat coplanar header flange 30 with the tube slots 26 formed between each longitudinal flange 30. The header 22 extends from the flanges 30 in a semi-circular or tubular configuration to provide the fluid chamber 20 therein allowing flow of the liquid through the chamber 20 and into and out of the extruded tubes 16. The flange 30 provides an abutting coplanar surface 34 for sealing.

Figure 3:
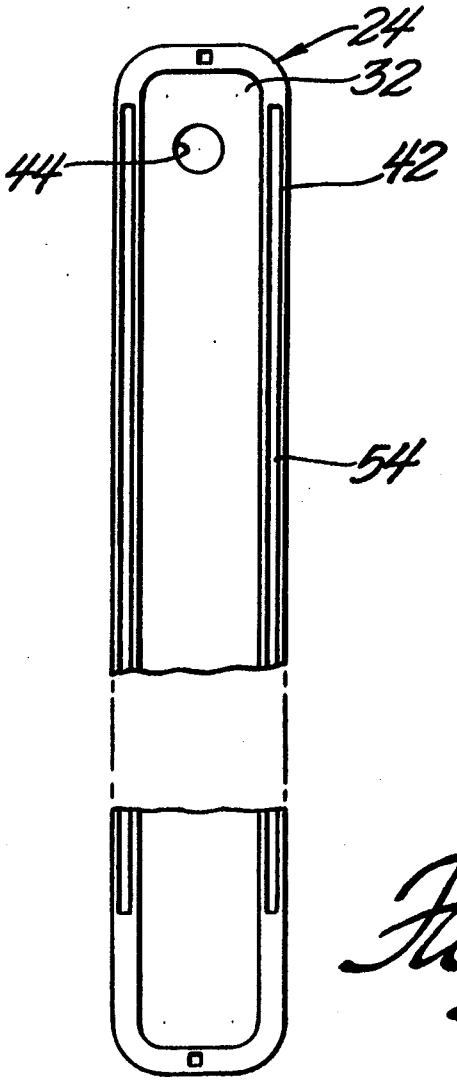
FIG. 3 is an enlarged front elevational view of the tank of the subject invention taken along lines 3—3 of FIG. 1.

The tank 24 is best illustrated in FIGS. 2 and 3. The tank 24 provides a recessed or semi-circular longitudinal portion 32 joined to header 22 to complete the chamber 20 so as to allow the flow of fluid therein. The recessed portion 32 is surrounded by a flat coplanar tank flange 42 providing a parallel flat abutting surface 36 for mating or abutting with the parallel header flange 30 at the surface 34 thereof. In other words, the header and tank flanges 30, 42 are parallel to one another when assembled and are coplanar at surfaces 34, 36 on each header 22 and tank 24. The flange 30, 42 may include a slight angle for brazing.

The tank 24 includes one aperture 44 therein for providing an inlet connection of the refrigerant to the heat exchanger 10. The second tank unit 13 includes an outlet aperture (not shown) for a single pass heat exchanger. The connection of the inlet 46 and outlet tubes to the heat exchangers 10 is commonly known in the art as described in U.S. Pat. No. 4,971,145 set forth in the Background and incorporated by reference herein.

Conventional aluminum heat exchanger materials are employed so that conventional brazing can be used. The header 22 and tank 24 may be extruded from a base material of aluminum 3003 and are clad with aluminum 4343 which serves as brazing material. Alternately, other alloy combinations appropriate to the intended brazing process may be used. With braze cladding on the oppositely facing sides of the tank and header, when the tank 24 and header 22 are elevated to a braze temperature, a brazed joint will be formed at the mating surfaces or flanges thereof.

Furthermore, the flanges 30, 42 include locking means 50 extending therethrough and within the flanges 30, 42 for securing and locking the tank 24 to the header 22 while applying sufficient contact pressure between the parallel abutting surfaces 34, 36 during the braze cycle. The locking means 50 allows the flanges 30, 42 to be held against one another to allow sealing between the joints by clad material thereof during brazing of the apparatus 10. There are five embodiments of the locking means, any of which are suitable to lock the header 22 to the tank 24.

Four embodiments of the locking means 50 are illustrated in FIGS. 3 and 5–7. In FIG. 2, the tank flange 42 includes a shaped longitudinal projection 52 extending through and from the coplanar surface 36 of a predetermined configuration for locking through and with the header flange 30. The header flange 30 also includes a longitudinal projection 54 extending in the same direction as projection 52. The projection 54 forms a pocket 56 having a configuration complementary to the configuration of the tank projection 52. The tank projection 52 is received within the pocket 56 and is retained therein for locking the header 22 to the tank 24. It is to be understood that the projection 32 and pocket 54 may be switched in place on the opposite flanges 30, 42. The projection 52 and pocket 56 extend substantially the length of each side of the header 22 and tank 24.

Each embodiment of the locking means 50 will be hereinafter described in detail. It is to be understood that parts with similar function are designated by numerals having the same last two digits to represent like components. In each embodiment the first digit, e.g., 100, 200, 300 digit, designates different embodiment.

With regard to the first embodiment in FIG. 2, projection 52 may be stamped within the tank 24 and is formed with a base 56 having a pair of inclined convergent arms 58 extending from the base 56 therefrom to the flange 42. The inclined arms 58 provide an entrance opening 57 within and through the flange 42 less than the width of the base 56. The pocket 54 includes a similar configuration having a base 60 with inclined convergent arms 62 providing an entrance or opening 64 to the pocket 54 of a width less than the width provided along the base 60. The tank projection 52 is press fit into the pocket 54 of the header 22 to provide an interference fit between the tank 24 and the header 22. The tank 24 is braze coated so that when the braze joined is formed, a long continuously sealed joint is made between the tank projection 56 and header pocket 54 around the full perimeter thereby.

Figure 5:
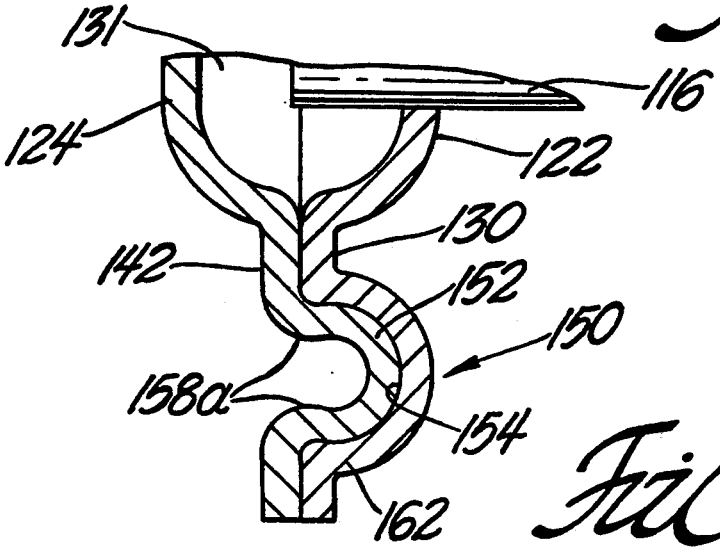
FIG. 5 is an enlarged fragmentary sectional view taken as in FIG. 2 of a second embodiment of the locking means.

The second embodiment of a locking means 150 is illustrated in FIG. 5. The locking means 150 includes a longitudinally projection 152 on the tank 124 and a pocket 154 formed within the header 122. In this design, the projection 154 is generally circular in shape, with a similar pocket 154 formation. The circular projection 152 provides a ¾ circumference of a circle. The circle has an opening **158*a* therein between inclined arms 158 at the top of the circle. The projection 152 is in an interference fit within the pocket 154 as in the case of the embodiment of FIG. 2. The locking action between the projection 152 and the pocket 154 will join the parts to secure the header 122 to the tank 124 and to form a brazed joint therebetween that seals a fluid chamber 131**.

Figure 6:
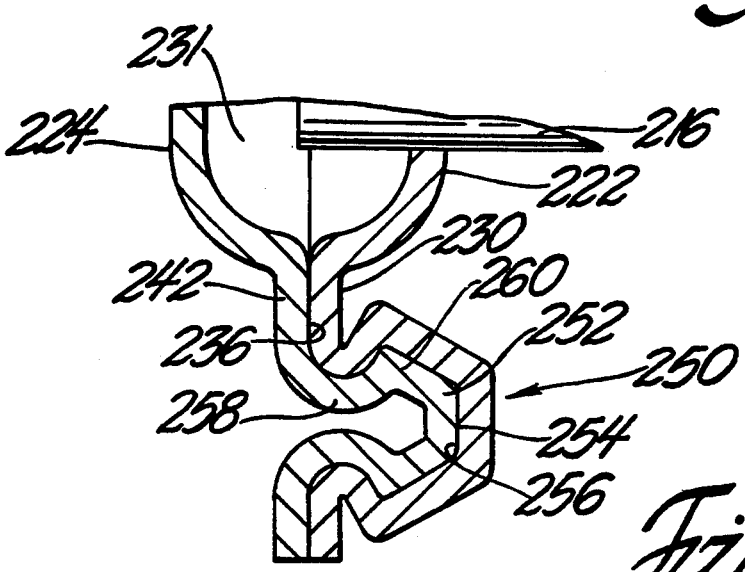
FIG. 6 is an enlarged fragmentary sectional view taken as in FIG. 2 of a third embodiment of the locking means.

FIG. 6 illustrates a third embodiment of the locking means 250. In this embodiment, a projection 252 is provided on the tank flange 242 of tank 222, and a pocket 254 is formed within the header 222 in the header flange 230 thereof. In this embodiment, lead-in is provided at the projection 252 by tapering inwardly convergent arms 260 extending from the inclined arms 258 to the base 256. The pocket 254 has a surface configuration convergent to the outer surfaces of the projection 252 so as to provide a locking action between the tank flange 242 and header flange 230 such that a sealed brazed joint will be provided therebetween during brazing. That will join the parts and seal a fluid chamber 231.

Figure 7:
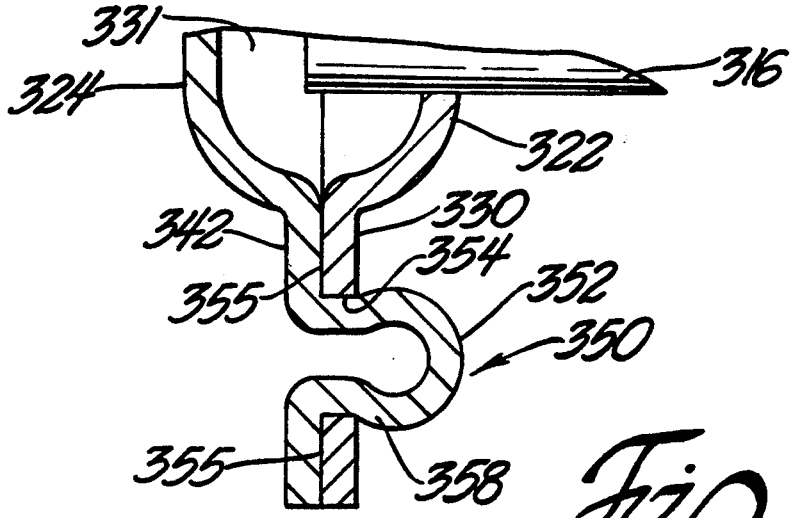
FIG. 7 is an enlarged fragmentary sectional view taken as in FIG. 2 of a fourth embodiment of the locking means.

FIG. 7 shows a fourth embodiment of the locking means 350. In this embodiment, an longitudinal aperture or slot 354 is provided within the header 22 in place of the pocket. A tank projection 352 is configured similar to the projection 152 of the second embodiment illustrated in FIG. 6. The projection 352 is snapped into the slot 354 and maintained therein along its inclined walls 358. The locking action between projection 352 and header flange 330 will engage the header flange 330 and a tank flange 342 at an interface 355 therebetween. A brazed joint will be formed between the walls 358 and a header flange 330 to secure the header 322 to the tank 324 and to seal a fluid chamber 331 therebetween.

Figure 8:
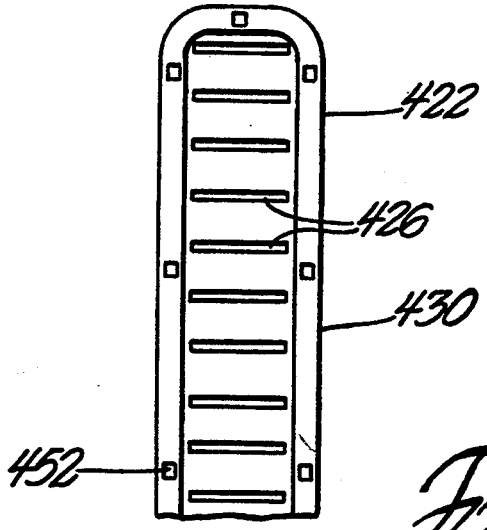
FIG. 8 is a partial front elevational view of the header used in the fifth embodiment.
Figure 9:
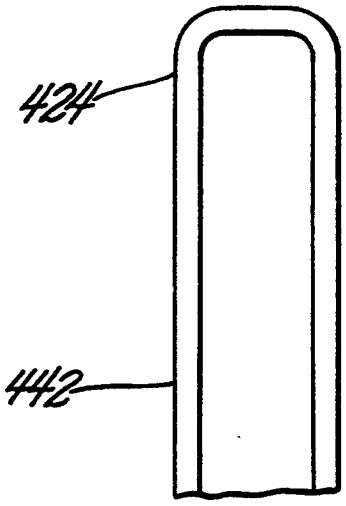
FIG. 9 is a partial front elevational view of a tank used in the fifth embodiment.
Figure 10:
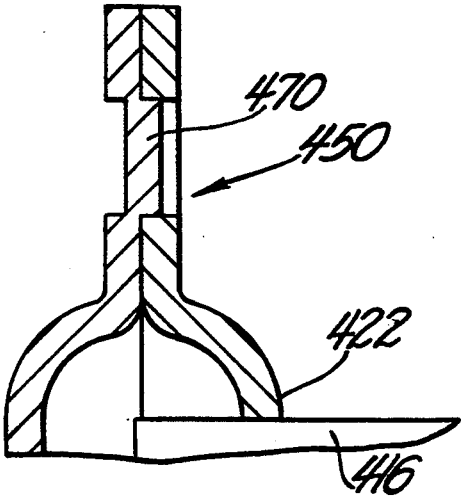
FIG. 10 is an enlarged fragmentary sectional view of a joint formed in the fifth embodiment between the header and tank of FIGS. 8 and 9.

FIGS. 8–10 illustrate a fifth embodiment of the subject invention. The locking means 450 includes a punched retaining member 470 from either the tank 424 or header 422. A plurality of holes or apertures 452 are formed or punched in either of the flanges 430, 442 of the header 422 or tank 424. To illustrate the invention, it is shown to have the holes 452 punched out of the header 422. However, it is to be understood that the tank 424 may be utilized in the inverse. The holes 452 are on the order of 1/16 inch to 1/8 inch. After holes 452 are formed in only the header 422, the header 422 and tank 424 are aligned with one another. The retaining member 470 is formed by punching through the tank 424 at points aligned with the holes 452 forming plugs 470 partially extending into the holes 452. The plugs 470 are positioned across the joint between the header 422 and tank 424, and extend partially therein to maintain the assembly. The plugs 470 are formed of the same piece punched out of the tank 424. The header 422 or tank 424 is a braze coated aluminum so that once apparatus 10 is assembled with the core 14, all joints will be sealed. The plugs 470 overlap against each the header 422 and tank 424.

Also provided is the method of making a heat exchanger apparatus 10 of the type having a pair of tank units 12, 13 with parallel flow passes 16 and air centers 18 therebetween. The method includes the steps of extruding a tank 24 with formed coplanar flat flanges 42 thereabout and recessed portion 32 forming the fluid chamber 20, extruding a header 22 having a flat coplanar flange 30 thereabout, forming locking means through the flanges 30, 42 to lock the tank 24 to the header 22, piercing the tube slots 26 in the header 22, assembling the tank 24 to the header 22, locking the locking means between the flanges 30, 42, and brazing the assembly apparatus 10 to form brazed joints between the flanges 30, 42 of the header 22 and tank 24. The method also includes the step of locking comprising forming a projection or snap 52 through the tank flange 42 extending from the abutting surface 36, and forming a pocket or aperture 54 through the header flange 30 such that the projection 52 is retained in an interference fit within the pocket or aperture 54 of the header 22. The step of locking may alternatively comprise punching a plurality of aligned apertures 452 in and along one of the header flange 430 or tank flange 442, aligning the header 422 and tank 424, and punching a plug 470 from the non-apertured flange 430, 442 through the aligned apertures 452 to secure the header 22 to the tank 24. The header 422 and tank 424 may be formed from flat aluminum stock by a stamping process.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A heat exchanger apparatus of the type including a pair of longitudinal tank units supporting a core therebetween, the core having a plurality of parallel flow tube passes extending between the tank units and including air centers connected between for directing air flow therethrough and conductive heat transfer with the tube passes, said apparatus comprising:

a pair of tank units providing a fluid chamber therein in fluid communication with the tube passes;

said tank units comprising a separate header and tank each having flat coplanar flanges extending along the periphery of said header and tank providing parallel flat abutting surfaces along the periphery to seal the tank to the header forming the tank unit during brazing thereof, said abutting surfaces of said flanges of the header being parallel to said flanges of said tank for providing uniform contact surfaces therealong;

said flanges including locking means extending through and along the parallel surfaces of the flanges for locking the tank to the header with the flat flanges adjacent one another;

said header including an opening through the flange thereof, said locking means including a projection extending from the flange of the tank and through the opening of said header to maintain the header adjacent the tank and said uniform contact surfaces around said opening and said projection;

said locking means including a longitudinal pocket formed through said flange of said header extending from said opening for receiving said projection therein, said projection extending from said abutting surface of said flange of said tank, said projection and pocket having a complimentary configuration to provide abutting surfaces between said pocket and said projection.

* * * * *